US006378427B1

(12) United States Patent
Endisch

(10) Patent No.: US 6,378,427 B1
(45) **Date of Patent: *Apr. 30, 2002**

(54) PROCESS AND DEVICE FOR MODIFYING THE TEMPERATURE OF THE INKING UNIT OF A WEB-FED ROTARY PRINTING MACHINE

(75) Inventor: Martin Endisch, Wertingen (DE)

(73) Assignee: MAN Roland Druckmaschinen AG, Offenbach am Main (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/996,629

(22) Filed: Dec. 23, 1997

(30) Foreign Application Priority Data

Dec. 23, 1996 (DE) ..... 196 54 060

(51) Int. Cl.[7] ..... B41F 31/00; B41F 23/04

(52) U.S. Cl. ..... 101/349.1; 101/352.01; 101/487

(58) Field of Search ..... 101/350.1, 207–210, 101/148, 351.1, 352.01, 352.02, 352.04, 487, 488, 349.1, 350.2, 171, 181, 216, 219, 211, 416.1

(56) References Cited

U.S. PATENT DOCUMENTS

| | | | | | |
|---|---|---|---|---|---|
| 1,234,403 | A | * | 7/1917 | Smith | 101/350.4 |
| 2,297,005 | A | | 9/1942 | Livingston | |
| 2,406,928 | A | * | 9/1946 | Taylor et al. | 101/350 |
| 2,972,298 | A | * | 2/1961 | De Marchi et al. | 101/211 |
| 2,972,303 | A | * | 2/1961 | De Marchi et al. | 101/487 |
| 3,584,579 | A | * | 6/1971 | Rothenberg | 101/350 |
| 3,986,452 | A | * | 10/1976 | Dahlgren | 101/148 |
| 4,007,683 | A | * | 2/1977 | Dickerson | 101/363 |
| 4,088,074 | A | * | 5/1978 | Dahlgren et al. | 101/350 |
| 4,165,688 | A | * | 8/1979 | Leanna et al. | 101/207 |
| 4,375,190 | A | * | 3/1983 | Quinci et al. | 101/177 |
| 5,081,928 | A | * | 1/1992 | Harison | 101/350.2 |
| 5,140,900 | A | * | 8/1992 | Burch | 101/350 |
| 5,189,960 | A | | 3/1993 | Valentini et al. | |
| 5,566,613 | A | * | 10/1996 | Stoffler et al. | 101/350 |
| 5,595,115 | A | * | 1/1997 | Rau et al. | 101/142 |
| 5,826,505 | A | * | 10/1998 | Volz et al. | 101/183 |
| 6,006,664 | A | * | 12/1999 | Hummel et al. | 101/183 |

FOREIGN PATENT DOCUMENTS

| | | |
|---|---|---|
| DE | 74 23 17 | 11/1943 |
| DE | 34 01 886 | 8/1985 |
| DE | 44 31 188 | 5/1995 |
| FR | 2 294 050 | 7/1976 |

* cited by examiner

*Primary Examiner*—Eugene Eickholt
(74) *Attorney, Agent, or Firm*—Cohen, Pontani, Lieberman & Pavane

(57) ABSTRACT

To effectively cool the inking unit of a rotary printing machine during a machine stop, the inking unit can be driven during the machine stop by at least one motor, with the rubber-covered ink transport rollers having contact with the temperature-modified ink transport rollers.

13 Claims, 5 Drawing Sheets

PROCESS AND DEVICE FOR MODIFYING THE TEMPERATURE OF THE INKING UNIT OF A WEB-FED ROTARY PRINTING MACHINE

BACKGROUND OF THE INVENTION

1. Field of the Invention

The invention relates to a process and a device for modifying the temperature of the inking unit of a web-fed rotary printing machine in the event of stoppage of the machine. At least one ink transport roller, in particular, at least one ink distributor cylinder, has a temperature-modifying medium flowing through it in a fashion that can modify temperature. The invention can be used, for example, in rotary printing machines for offset or relief printing. Sheet-fed as well as web-fed rotary printing machines can be used.

2. Discussion of the Prior Art

During printing, heat develops in the inking units of rotary printing machines. The heat develops due to the flexing work of the rubber-covered ink transport rollers, e.g., the ink transfer rollers, the ink application rollers and the rider rollers. Heat is also released due to mechanical stress on the printing ink, e.g., during ink distribution and ink splitting. In fast rotary printing machines, greater heat develops. For this reason, inking unit temperature modification devices have already been proposed, such as that disclosed in U.S. Pat. No. 5,189,960. According to that reference, at least one inking roller is internally cooled during the printing operation. In practice, the ink distributor cylinders are advantageously used for this purpose.

A procedure of this type has the disadvantage that the cooling device loses effectiveness when the inking unit is shut down, e.g., during a machine stoppage. In this state, the lack of ink flow and the fact that the ink rollers do not roll on the cooled distributor cylinder cause the cooling of the ink rollers to be largely interrupted. As a result, the temperature profile established during machine operation in the rubber of the rubber-covered ink rollers levels out. Whereas during continuous printing the maximum temperature is located in the interior of the rubber layer, during a machine stop the temperature profile levels out, i.e., the rubber surface becomes much warmer than under operating conditions. Printing inks must be optimized for these high temperatures. The tack of the ink nonetheless changes during such machine stops, because a great deal of solvent evaporates from the ink on the ink rollers, which are heating up. When the machine is started up again after a machine stop, there is the danger of web breaks due to the adhesiveness of the ink that accompanies its initially increased tack, which causes the web to stick, e.g., on the transfer cylinder. In extreme cases, the ink completely loses its splitting ability. Finally, the change in tack leads to start-up spoilage.

SUMMARY OF THE INVENTION

Accordingly, it is an object of the present invention to provide a process and a device for modifying inking unit temperature during a machine stop.

Pursuant to this object, and others which will become apparent hereafter, one aspect of the present invention resides in a process for modifying the temperature of an inking unit of a rotary printing machine, which inking unit includes at least one ink transport roller, and rubber-covered ink transfer rollers. The process includes the steps of passing a temperature modifying medium through the at least one ink transport roller, and driving the inking unit during stoppage of the printing machine with the rubber-covered ink transport rollers in contact with the at least one temperature modifying ink transport roller.

Another aspect of the invention resides in a device for modifying the temperature of ink carrying units of a rotary printing machine, which device includes at least one ink transport roller through which a temperature modifying medium flows, rubber-covered ink transport rollers, and at least one motor operatively arranged to drive the inking units during stoppage of the printing machine with the rubber-covered ink transport rollers in contact with the at least temperature-modified transport roller.

Because the inking unit continues to run during a machine stop, effective cooling continues to be provided for the rubber-covered ink transport rollers, thanks to the rolling contact of the latter with the cooled ink transport rollers. An increase in the surface temperature of the rubber-coated rollers is thus avoided. This makes it possible to optimize the printing ink based on the temperature level during continuous printing. Inks that are optimized for continuous printing have improved drying properties. Furthermore, during machine stops, the tack of the ink changes to a lesser extent than before, so that start-up spoilage and the danger of web breaks is reduced.

The reasons for machine stoppage can be many e.g., in the event of web breaks or other malfunctions or for production changes.

In another embodiment of the inventive process the supply of ink to the inking unit is interrupted during stoppage of the machine.

In yet another embodiment the inking unit is driven at a speed below a maximum possible printing speed. The inking unit can also be driven at a speed approximately between a washing speed and a drawing-in speed.

In another embodiment of the inventive device, a cylinder is provided that prints on printing stock. The inking unit is in a separable drive connection with the cylinder. The at least one motor is arranged so as to drive the inking unit when it is separated from the cylinder in terms of drive.

In still another embodiment of the device, two printing groups for printing on a web are provided. Each of the printing groups has an inking unit, and means are provided for placing the inking units into drive connection so as to be driven by the motor.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
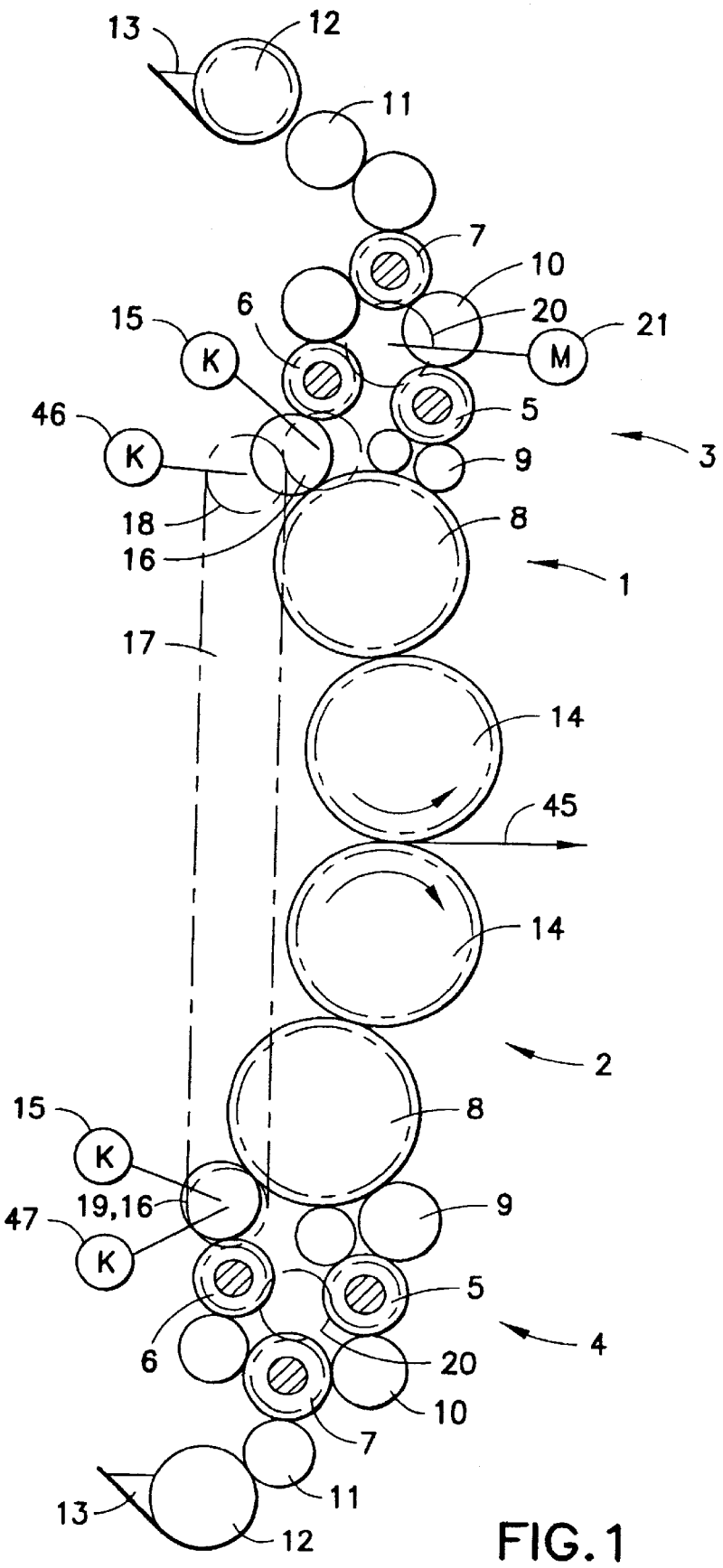
FIGS. 1–1*b* schematically show various embodiments and states of operation of a printing unit for offset printing with two printing groups with corresponding inking units.

The printing unit for offset printing shown in FIG. 1 contains two printing groups 1, 2 that work together in the blanket-to-blanket method and have the respective inking units 3, 4. Each inking unit 3, 4 has three ink transport rollers, also called distributor cylinders 5, 6, 7. Resting on the distributor cylinders 5, 6 are transport rollers, also called application rollers 9, which can be positioned onto the form cylinders 8. Further, each inking unit 3, 4 contains inking rollers 10, a film roller 11 and a ductor 12 with an ink box 13. The application rollers 9 and the ink rollers 10 have a rubber covering; in all cases, rubber-like coverings could also be used. For the sake of simplicity, the same reference numbers are generally used for the same individual parts in the printing groups 1, 2 and the inking units 3, 4. For the same reason, different individual item numbers are not assigned for multiple application rollers and ink rollers. On their journals, the cylinders 5, 6, 7 carry a spur gear, by means of which these cylinders are in drive connection, via intermediate gears, with a cylinder gear of the form cylinder 8. For the sake of simplicity, reference numbers are not given for all of these gearwheels, which are indicated only by the dashed-dotted lines representing their reference diameters. For drawing-related reasons, these diameters have been shown somewhat enlarged or reduced in size. The drive of the printing group, whose printing group cylinders 8, 14 are engaged via spur gears (cylinder gears) located on journals, is implemented, e.g., by a main shaft, or one of the cylinders 8, 14 is in drive connection with a motor.

Each of the distributor cylinders 5, 6, 7 is equipped with an internal temperature modifying device, which is shown symbolically in all examples by central hatching. Those skilled in the art will be familiar with such devices. A temperature modifying device of this type is disclosed, for example, in U.S. Pat. No. 5,595,115, the disclosure of which is incorporated herein by reference. During printing operation, the distributor cylinders 5, 6, 7 of the inking units are driven by the form cylinder 8. During machine stoppage, the transfer cylinders 14 that print the web 45 stop moving, as do the form cylinders 8 in toothed engagement with them. So that the inking unit 3, 4 can continue to operate, it is disconnected with respect to drive from the form cylinder 8. A coupling 15, which is shown schematically, interrupts the drive connection established by means of the intermediate gear 16 between the form cylinder 8 and the distributor cylinder 6. Solutions for carrying this out are known to those skilled in the art, for example, the intermediate gear 16 can be shifted axially and thus moved out of toothed engagement with the cylinder gear of the form cylinder 8. The inking units 3, 4 are then connected to each other with respect to drive. In FIG. 1, a chain drive 17 is provided for this purpose. The chain gear 18 is moved by means of a coupling 46 into drive connection with the intermediate gear 16, while the latter remains in toothed engagement with the spur gear of the distributor cylinder 6. Advantageously, the intermediate gear 16 disengaged from the cylinder gear can, when the shifting movement occurs, engage into a spur gear connected to the chain gear 18. The other chain gear 19 is connected to the lower intermediate gear 16 by means of a coupling 47, for example, a claw coupling, which engages when the shifting movement of the intermediate gear 16 takes place. The two inking units 3, 4 are then driven by a motor 21, which advantageously drives one of the toothed gears of one of the inking units 3 or 4. Advantageously, the intermediate gear 20, which is engaged with the spur gears of the distributor cylinders 5, 6, 7, is driven. The drive speed for the inking units 3, 4 can be selected as desired and the motor 21 is selected and operated accordingly. A speed below the maximum possible printing speed is advantageous, for example, a speed lying approximately between washing and drawing-in speed, depending on the basic parameters. Advantageously, an electric motor or a hydraulic motor is used.

Figure 1A:
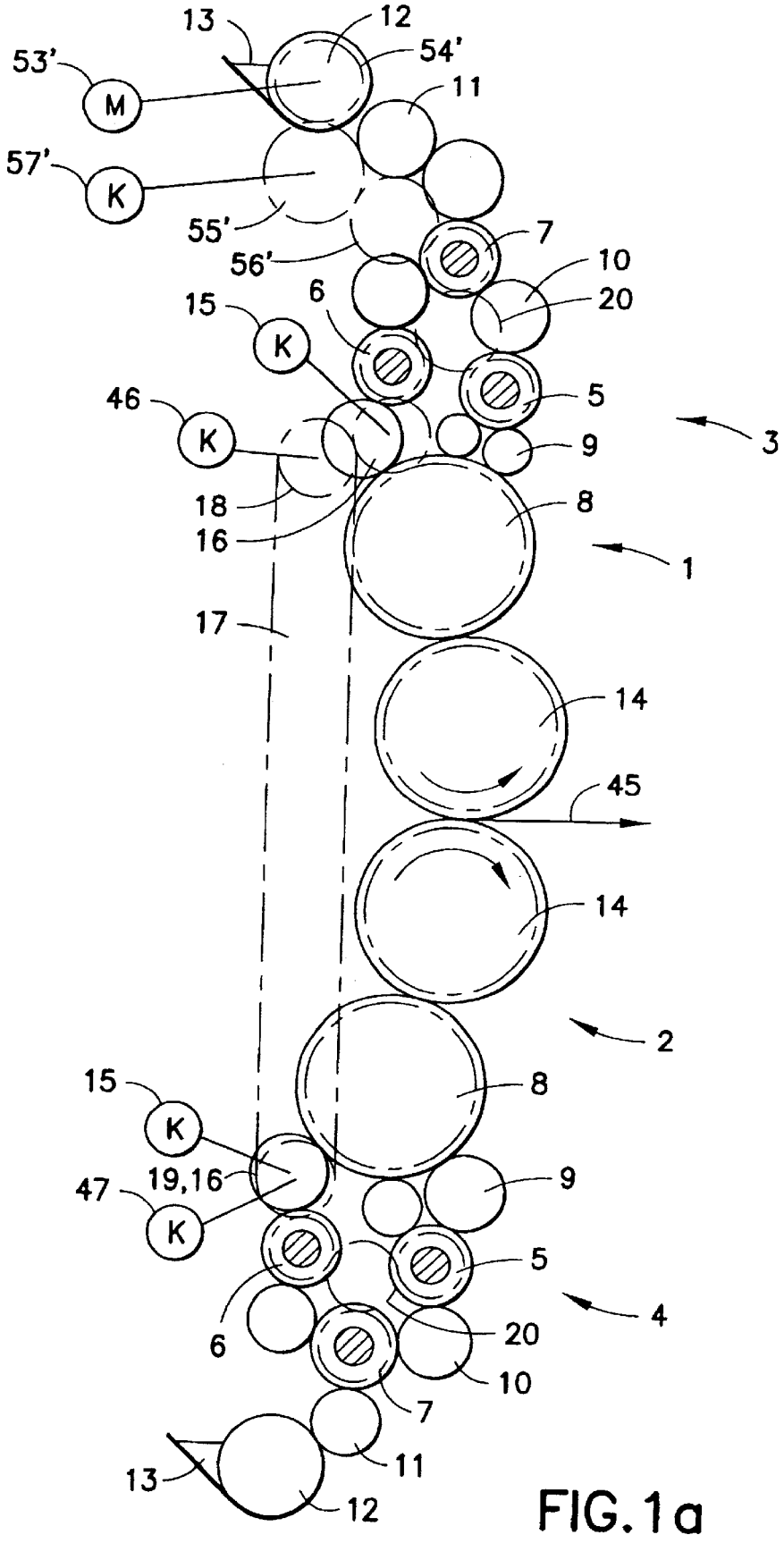
Figure 1B:
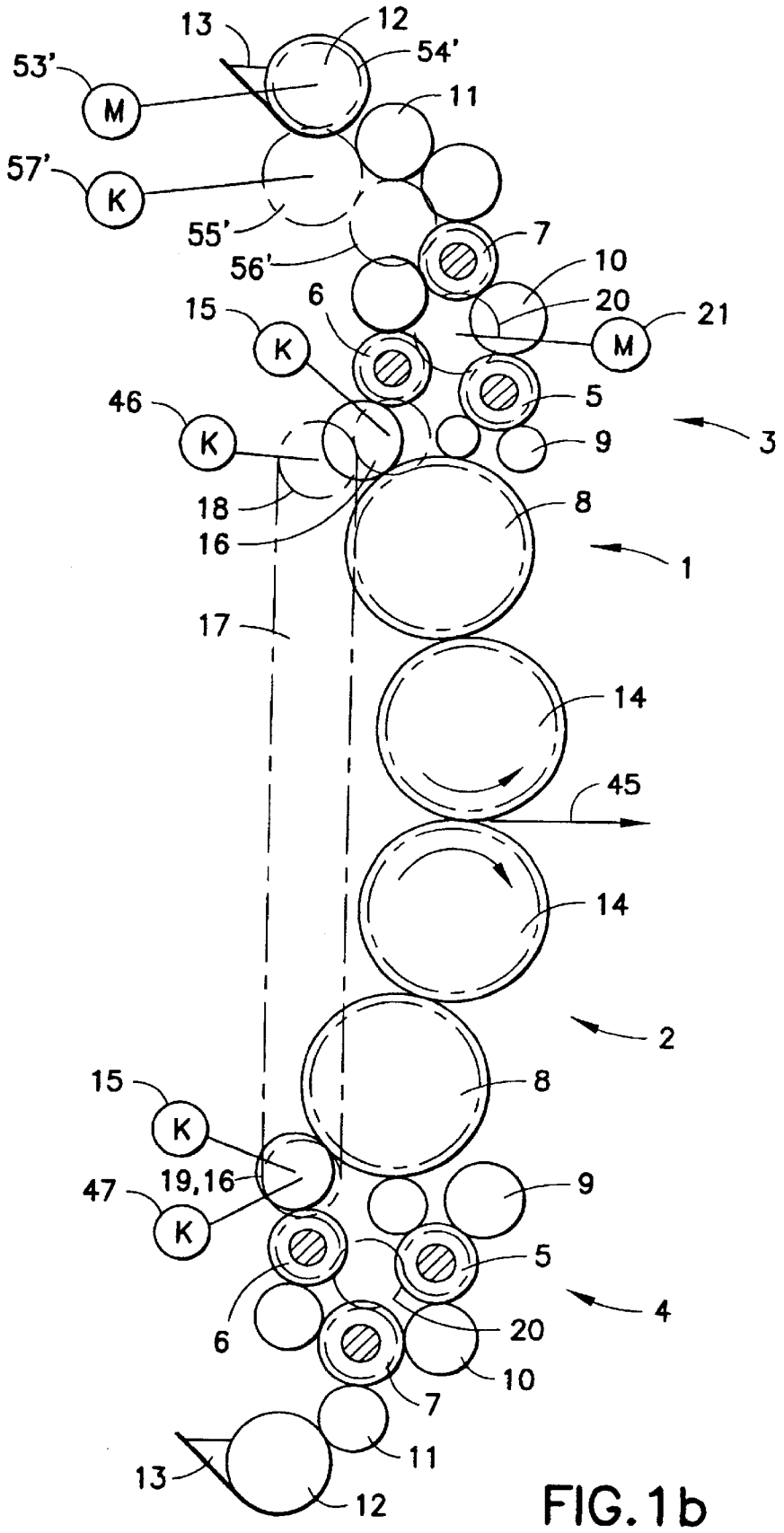

The inking units 3, 4 are driven with the application rollers 9 in the away position, i.e., the application rollers 9 are moved away from the form cylinder 8 in the known manner and continue to have contact with the distributor cylinders 5, 6 (see FIG. 1*b*). Advantageously, the movement away from the form cylinder 8 is a pivoting movement around the rotational axes of the distributor cylinders 5, 6. Further, the ink supply is moved away, i.e., the film roller 11 is pivoted away from the ductor 12 to interrupt the supply of ink to the inking unit. However, the ink supply does not have to be moved away. Instead, using the film roller 11, the ink can be taken from the ductor 12 by means of a siphon. Instead of the chain drive 17, other means can be used for the drive connection of the two inking units, for example, a cardan shaft or a train of intermediate gears. Omitting the drive connection, each of the two inking units 3, 4 can be equipped with its own drive motor 21. Furthermore, when the inking units 3, 4 are driven, the form cylinder 8 can also rotate, if it is not in drive connection with the transfer cylinders 14, or if such a drive connection has been released. If, for example, each of the form and transfer cylinders 8, 14 is equipped with its own drive motor, the drive connection between the form cylinder 8 and the inking unit 3 or 4 can be maintained and the driven form cylinder 8 can drive the particular inking unit 3, 4, whereby the motor 21 and the chain drive 17 are omitted. During machine stops, the transfer cylinders 14 are then moved away from the form cylinder 8 in question. Drives for the printing group cylinders 8, 14 are known to those skilled in the art and disclosed, for example, in DE 44 30 693 A1 and U.S. patent application Ser. No. 08/386,371, the disclosure of which is incorporated herein by reference.

In the event of machine stoppage after a long high-speed production run, the rubber-covered application and ink rollers 9, 10 are well cooled by being in rolling contact with the temperature-modified (in this case, cooled) distributor cylinders 5, 6, 7. The temperature-modifying medium, e.g., water, is supplied by a temperature modification station. Advantageously, the temperature of the rollers 9, 10 is controlled so that the inking unit 3, 4 does not fall below a preset temperature. To this end, the temperature of one or more rollers 9, 10 is scanned by means of a thermosensor, e.g., a UV sensor. The signal of the thermosensor(s) is compared to a target value and the influx of temperature-modifying medium to the distributor cylinders 5, 6, 7, depending on the differential signal, is regulated or the inking unit is shut down. The temperature-modification system can also be used in the preparatory phase of printing operations to preheat the printing groups 1, 2 by first supplying a suitably heated temperature-modifying medium to the friction cylinders 5, 6, 7. Control circuits for temperature modification are described in the aforementioned U.S. Pat. No. 5,595,115.

In FIG. 1, no wetting unit is provided. Thus, the inking units 3, 4 are intended for water-less offset printing. However, a wetting unit could be provided, and the inking unit temperature-modifying device could be used for conventional offset printing. When the wetting unit is omitted, it is also possible to print using the letterset method.

FIG. 1*a* shows yet another possibility for driving the inking unit 3 for the purpose of temperature modification. To identify this further option, the reference numbers of individual parts are marked with an "'". The motor 53' of the ductor 12 is used for the drive, and the motor 21 becomes unnecessary. A spur gear 54' on the axis of the ductor 12 is in drive connection via two intermediate gears 55', 56' with the spur gear of the distributor cylinder 7. This drive can be disconnected by means of a coupling 57'. For example, the coupling 57' can be realized in such a way that the intermediate gear 55' is embodied as a sliding gear that can be disengaged from the spur gear 54' by sliding.

For inking unit temperature modification during a machine stop, the inking units 3, 4 are disconnected by means of the couplings 15 from the form cylinder 8. After this, the intermediate gear 55' is brought into engagement with the spur gear 54' and the intermediate gear 56' by means of sliding. The inking unit 3 is then driven by the motor 53'. The ductor 12 can also be disconnected from the motor 53'. The function is otherwise analogous to that of the inking unit 3 driven by means of the motor 21.

Figure 2:
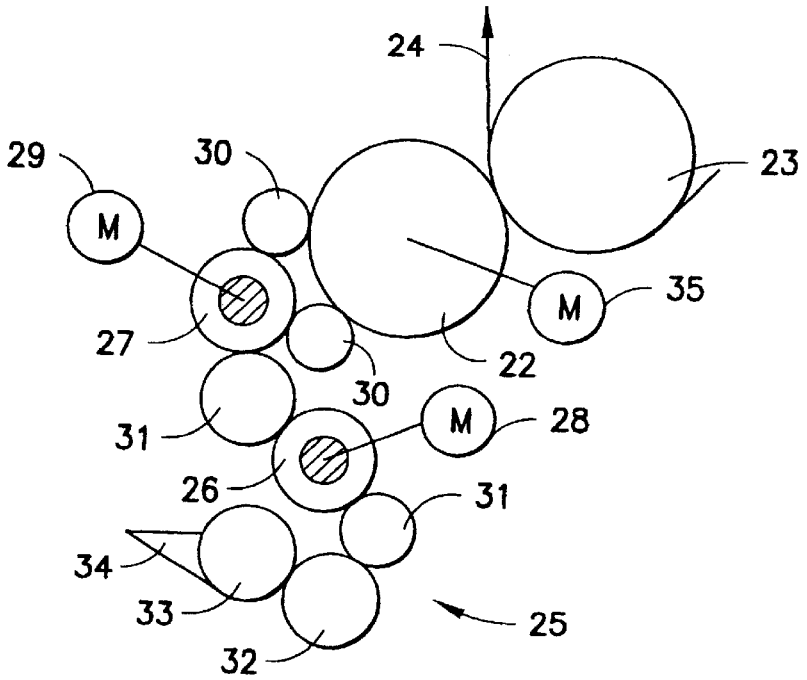
FIG. 2 shows a printing group with inking units for relief printing.

Advantageously, inking unit temperature modification can also be used with inking units that have their own drives or inking units in which each distributor cylinder is driven by its own drive motor. The latter case is shown in FIG. 2 in the example of an inking unit for a printing group operating in relief printing. The printing group contains a form cylinder 22, which prints a web 24 while positioned on a counterpressure cylinder 23. The inking unit 25 contains two distributor cylinders 26, 27, each having a motor 28, 29, two application rollers 30, ink rollers 31, a film roller 32 and a ductor 33 including an ink box 34. The form cylinder 22 and the counterpressure cylinder 23 are in drive connection and are driven by a motor 35. However, another type of traditional drive, e.g., by a main shaft, would also be possible.

During a machine stop, the form cylinder 22 and the counterpressure cylinder 23 stand still. The application rollers 30 are moved away from the form cylinder 22 in the usual manner and continue to rest on the distributor cylinder 27. The ink supply can be interrupted by pivoting the film roller 32 away from the ductor 33. The distributor cylinders 26, 27 are then driven by their motors 38, 29 and cool the application and inking rollers 30, 31.

Figure 3:
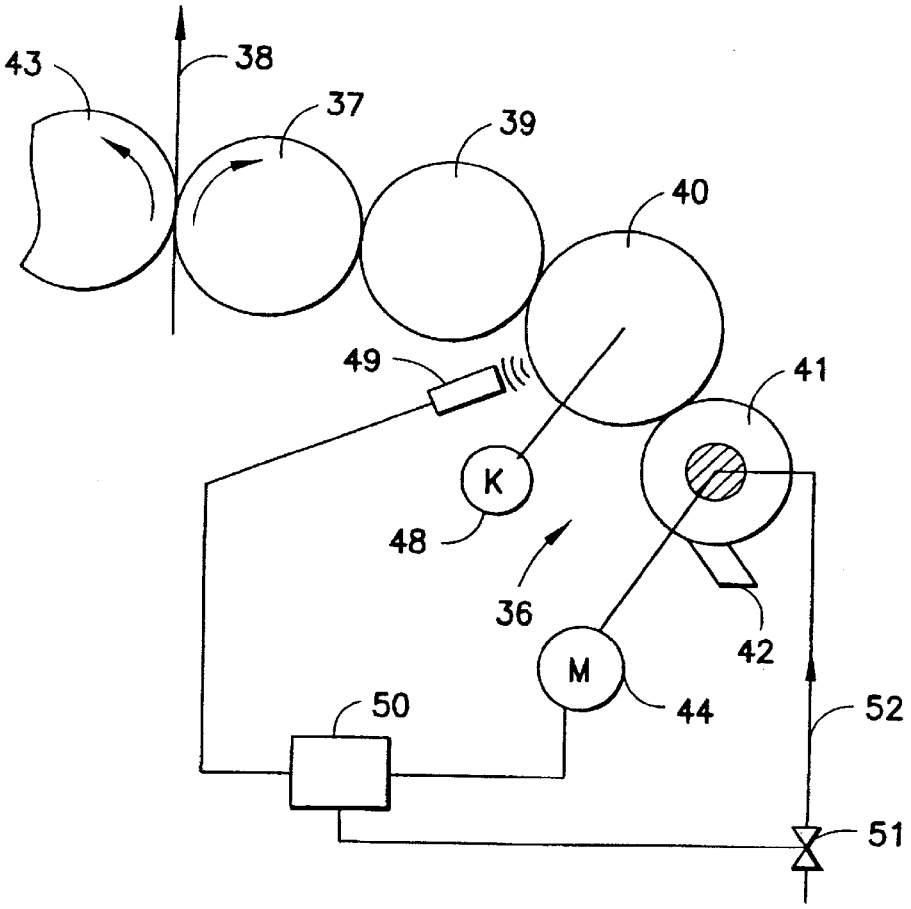
FIGS. 3 and 3*a* show an offset printing group with an anilox inking unit.

FIG. 3 shows an offset printing group with an anilox inking unit 36. Only the counterpressure unit with which such a printing group generally works in blanket-to-blanket printing is indicated. The transfer cylinder 37, which interacts with a similar cylinder 43 of the other printing group, prints on a web 38. Resting on the transfer cylinder 37 is a form cylinder 39, which is inked by an application roller 40. The application roller 40 is supplied with ink by a screen roller 41, which is inked by a chamber blade 42. A temperature-modifying medium flows through the screen roller 41. The anilox printing group 36 (like the printing groups 1 and 2 in FIG. 1) can be supplemented by a counterpressure cylinder to form a so-called three-cylinder printing group.

Figure 3A:
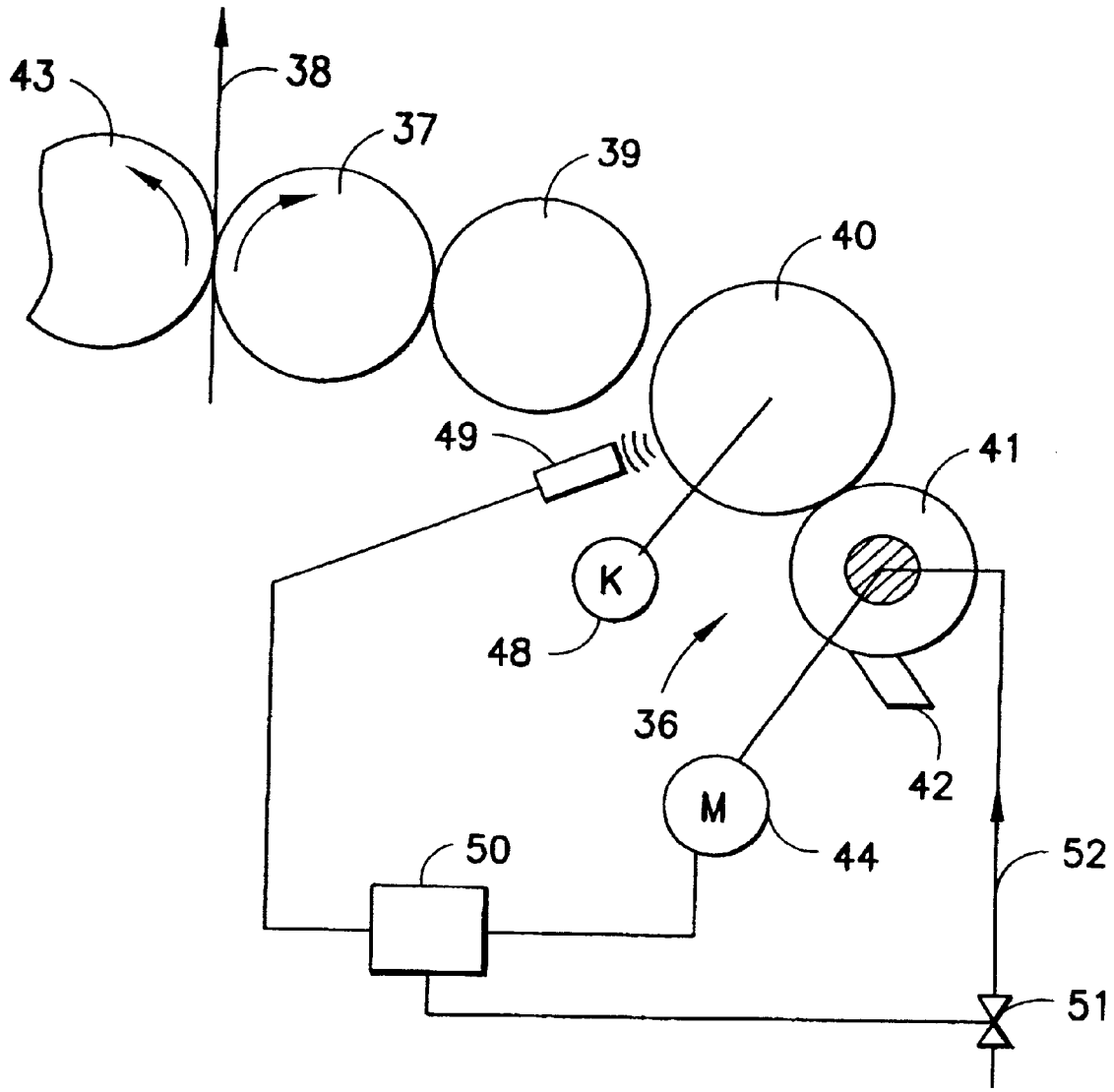

The transfer cylinder 37, the form cylinder 39, the application roller 40 and the screen roller 41 are in drive connection with cylinder gears that are not shown. The drive itself is carried out, for example, by the transfer cylinder 43, whose cylinder gear is engaged with the cylinder gear of the transfer cylinder 37. The drive of the anilox inking unit 36 is thus carried out indirectly by the transfer cylinder 37 via the form cylinder 39. During a machine stop, i.e., a shutdown of the transfer and form cylinders 37, 39, the application roller 40 is pivoted away from the form cylinder 39, specifically, in such a way as to remain in contact and drive connection with the screen roller 41. This position is shown in FIG. 3*a*. The drive connection of the application roller 40 to the form cylinder 39 is interrupted by release of the coupling 48, and the ink supply to the screen roller 41 is optionally interrupted, in that the chamber blade 42 is pulled back. The motor 44, to which the screen roller 41 is connected, is then activated, and the screen roller 41 is driven along with the application roller 40. During a machine stop after a long high-speed production run, the application roller 40 is then cooled by rolling contact with the screen roller 41. Of course, the screen roller 41 has a dosing function along with its ink transport function. In the event of drive separation between the transfer cylinder 37 and the form cylinder 39, it is possible for the form cylinder 39, the application roller 40 and the screen roller 41 to be driven during a machine stop, while the drive connection of these cylinders 39 to 41 and the contact of the application roller 40 with the form cylinder 39 and the screen roller 41 are maintained (advantageously, but not necessarily, with an interrupted ink supply). In this case, the motor 44 can also be omitted if the form cylinder 39 has its own drive motor.

The particular drive of the inking units 3, 4, 25, 36 can be engaged during a machine stop manually or in the framework of machine control.

In FIG. 3, a thermosensor 49 is directed toward the application roller 40, the output of the thermosensor 49 being connected to a control device 50. The thermosensor 49 can also scan multiple rubber-covered ink transport rollers, if present (FIGS. 1 and 2), or multiple thermosensors can be used for the rubber-covered ink transport rollers. The control device 50 is connected to the motor 44.

The signal that the thermosensor emits based on the temperature of the application roller 40 is compared in the control device 50 to a target value. If the application roller 40 falls below a preset external temperature, the control device 50 sends a signal to switch off the motor 44. As a result, there is no further rolling of the application roller 40 on the screen roller 41, and thus there is no further cooling of the application roller 40. Another possible control variant that can be provided is indicated in FIG. 3. This is a line path that leads from the output of the control device 50 to an adjustment element 51 for the inflow 52 of the temperature modifying medium for the internal temperature modification of the screen roller 41. The supply of temperature modifying medium is controlled in accordance with the temperature modification requirements, and can be completely blocked if the temperature of the application roller 40 reaches a lower temperature limit. The temperature of the temperature modifying medium can also be controlled. This has already been discussed in reference to FIG. 1.

The invention is not limited by the embodiments described above which are presented as examples only but can be modified in various ways within the scope of protection defined by the appended patent claims.

I claim:

1. A process for modifying temperature of an inking unit of an offset rotary printing machine having a form cylinder, which inking unit includes at least one ink transport roller, and rubber-covered ink transport rollers, the process comprising the steps of:

passing a temperature modifying medium internally through the at least one ink transport roller;

stopping the ink supply and preventing ink from being applied to the form cylinder during stoppage of the printing machine by moving the rubber-cover ink transport rollers from the form cylinder; and driving the inking unit during stoppage of the printing machine while the rubber-covered ink transport rollers are in contact with the at least one temperature-modified ink transport roller, thereby modifying the temperature of the offset inking unit by surface contact between the rollers.

2. A process as defined in claim 1, and further comprising the step of interrupting a supply of ink to the inking unit as the inking unit is driven during stoppage of the machine.

3. A process as defined in claim 1, wherein the inking unit driving step includes driving the inking unit at a speed below a maximum possible printing speed.

4. A process as defined in claim 1, including modifying temperature of the rubber-covered ink transport rollers so that temperature of the inking unit does not fall below a preset temperature.

5. A device for modifying temperature of an ink unit of a rotary printing machine, comprising:

at least one ink transport roller through which a temperature modifying medium is flowable;

rubber-covered ink transport rollers; and at least one motor operatively arranged to drive the inking unit during stoppage of the printing machine with the rubber-covered ink transport rollers in contact with the at least one temperature-modified ink transport roller whereby surface contact with the temperature-modified ink transport roller cools the rubber-covered ink transport rollers.

6. A device as defined in claim 5, and further comprising a cylinder that prints on printing stock, the inking unit being in separable drive connection with the cylinder during printing, the at least one motor being provided so as to drive the inking unit when the inking unit is separated from the cylinder in terms of drive.

7. A device as defined in claim 6, wherein the inking unit includes a ductor in contact with one of the ink transport rollers and a motor arranged to drive the ductor, the ductor motor being connectable to an inking unit that is separated in terms of drive from the cylinder during machine stoppage.

8. A device as defined in claim 6, wherein two printing groups for printing on a web are provided, an inking unit being provided for each of the two printing groups, and further comprising means for placing the inking units into drive connection as so to be driven by the motor.

9. A device as defined in claim 6, and further comprising a form cylinder driveably connected with the inking unit.

10. A drive as defined in claim 5, wherein the at least one motor includes a plurality of motors and the at least one ink transport roller includes a plurality of ink transport rollers, each of the temperature-modified ink transport rollers being in drive connection with a respective one of the motors.

11. A device as defined in claim 5, wherein the inking unit is an inking unit for an offset rotary printing machine.

12. A combination, comprising:

an offset rotary printing machine;

an inking unit arranged in the offset printing machine;

means for supplying ink to the inking unit;

a device for modifying temperature of the inking unit of the rotary printing machine, the device comprising:

at least one temperature modified ink transport roller through which a temperature modifying medium is flowable;

a rubber-covered ink transport roller;

at least one motor operatively arranged to drive the inking unit during stoppage of the printing machine while the rubber-covered ink transport roller is in contact with the at least one temperature modified ink transport roller whereby cooling of the rubber-covered ink transport rollers takes place via surface contact with the temperature-modified ink transport roller;

a form cylinder provided so as to be in driving connection with the inking unit during printing;

means for driving the form cylinder; and a transfer cylinder in drive connection with the form cylinder during printing and separated from the form cylinder during stoppage, the inking unit being drivable, during stoppage, in common with the form cylinder when the form cylinder is separated from the transfer cylinder in terms of drive, the at least one ink transport roller being a screen roller and the rubber covered ink transport roller being an application roller, the application roller being engaged with the form cylinder and the screen roller during stoppage.

13. A combination, comprising:

an offset rotary printing machine;

an inking unit arranged in the offset printing machine;

means for supplying ink to the inking unit; and a device for modifying temperature of the inking unit of the rotary printing machine, the device comprising:

at least one ink transport roller through which a temperature modifying medium is flowable;

rubber-covered ink transport rollers;

at least one motor operatively arranged to drive the inking unit during stoppage of the printing machine with the rubber-covered ink transport rollers in contact with the at least one temperature-modified ink transport roller whereby cooling of the rubber-covered ink transport rollers takes place via surface contact with the temperature-modified ink transport roller;

a form cylinder arranged to drive the inking unit during printing;

means for driving the form cylinder; and a transfer cylinder in drive connection with the form cylinder during printing and separated from the form cylinder during stoppage, the inking unit being drivable, during stoppage, in common with the form cylinder, when the form cylinder is separated from the transfer cylinder in terms of drive.

* * * * *